US011338354B2

(12) United States Patent
Harrop et al.

(10) Patent No.: US 11,338,354 B2
(45) Date of Patent: May 24, 2022

(54) FASTENING APPARATUS DIE CARTRIDGE AND METHOD OF FASTENING AT LEAST TWO SHEETS OF MATERIAL

(71) Applicant: Henrob Limited, Flintshire (GB)

(72) Inventors: Kieron Harrop, Wrexham (GB); Philip Williams, Wrexham (GB)

(73) Assignee: Atlas Copco IAS UK Limited, Flintshire (GB)

( * ) Notice: Subject to any disclaimer, the term of this patent is extended or adjusted under 35 U.S.C. 154(b) by 172 days.

(21) Appl. No.: 16/623,196

(22) PCT Filed: Jun. 15, 2018

(86) PCT No.: PCT/GB2018/051651
§ 371 (c)(1),
(2) Date: Dec. 16, 2019

(87) PCT Pub. No.: WO2018/229501
PCT Pub. Date: Dec. 20, 2018

(65) Prior Publication Data

US 2021/0138530 A1 May 13, 2021

(30) Foreign Application Priority Data

Jun. 16, 2017 (GB) ..... 1709663

(51) Int. Cl.
*B21J 15/02* (2006.01)
*B21J 15/36* (2006.01)

(52) U.S. Cl.
CPC ..... *B21J 15/025* (2013.01); *B21J 15/36* (2013.01)

(58) Field of Classification Search
CPC ..... B21J 15/025; Y10T 29/5377; Y10T 29/49943; Y10T 29/5118; Y10T 29/5343; Y10T 29/49956; Y10T 29/5307
See application file for complete search history.

(56) References Cited

U.S. PATENT DOCUMENTS

| | | | |
|---|---|---|---|
| 2,947,444 | A | 8/1960 | Taylor et al. |
| 3,100,932 | A | 8/1963 | Pipkin |
| 2004/0060958 | A1 | 4/2004 | Kondo |

(Continued)

FOREIGN PATENT DOCUMENTS

| | | | |
|---|---|---|---|
| CN | 203748688 | U | 8/2014 |
| CN | 105880457 | A | 8/2016 |

(Continued)

OTHER PUBLICATIONS

International Search Report with Written Opinion for related Application No. PCT/GB2018/051651 dated Sep. 27, 2018(11 Pages).

(Continued)

*Primary Examiner* — Jason L Vaughan
*Assistant Examiner* — Amanda Kreiling
(74) *Attorney, Agent, or Firm* — Michael Best & Friedrich LLP

(57) ABSTRACT

A fastening apparatus die cartridge comprises a main body defining a cavity configured to receive a plurality of dies; and an opening through which dies received by the cavity can be removed from the cavity; and an engagement portion configured to engage with a complementary engagement portion of a die changer of a fastening apparatus.

16 Claims, 7 Drawing Sheets

(56) References Cited

U.S. PATENT DOCUMENTS

| | | | | |
|---|---|---|---|---|
| 2006/0230609 | A1 | 10/2006 | Wang et al. | |
| 2016/0288198 | A1* | 10/2016 | Tripp | B23Q 3/15566 |
| 2016/0332216 | A1* | 11/2016 | Ahlemeyer | B21J 15/025 |
| 2017/0361410 | A1* | 12/2017 | Sato | B23Q 3/15536 |

FOREIGN PATENT DOCUMENTS

| | | | |
|---|---|---|---|
| CN | 106102956 | A | 11/2016 |
| DE | 202014102908 | U1 | 7/2014 |
| DE | 102014202729 | A1 | 8/2014 |
| DE | 102013021055 | A1 | 6/2015 |
| EP | 0270845 | A2 | 6/1988 |
| EP | 3093080 | A1 | 11/2016 |
| GB | 2514871 | A | 10/2014 |
| JP | 2016540648 | A | 12/2016 |

OTHER PUBLICATIONS

International Preliminary Report on Patentability for related Application No. PCT/GB2018/051651 dated Dec. 17, 2019 (8 Pages).
Chinese Patent Office Action for Application No. 201880052127.4 dated Jan. 5, 2021 (9 pages including English summary).
Search Report issued from the United Kingdom Patent Office for related Application No. GB1709663.7 dated Nov. 17, 2017 (3 pages).
Chinese Patent Office Action for Application No. 201880052127.4 dated Sep. 17, 2021 (16 pages with English translation).
Korean Intellectual Property Office Action for Application No. 10-2020-7001515 dated May 30, 2021 (8 pages with English translation).

* cited by examiner

FASTENING APPARATUS DIE CARTRIDGE AND METHOD OF FASTENING AT LEAST TWO SHEETS OF MATERIAL

CROSS-REFERENCE TO RELATED APPLICATIONS

This application is a U.S. national stage entry of International Application No. PCT/GB2018/051651, filed Jun. 15, 2018, which claims priority to G.B. Patent Application No. 1709663.7, filed Jun. 16, 2017, the entire contents all of which are hereby incorporated by reference herein.

SUMMARY OF THE INVENTION

The present invention relates to a cartridge or cartridge assembly, and, in particular, to a cartridge or cartridge assembly which may form part of a fastening apparatus. The fastening apparatus may be a rivet setter which utilises self-piercing rivets. The invention also relates to associated methods.

There are many known types of fastener which are used to secure two or more portions of a workpiece (for example, two or more sheets) together. One group of such known fasteners functions as follows. A fastener support is placed beneath the workpiece, and a fastener and fastener insertion device are located above both the fastener support and the workpiece. The fastener insertion device applies a force to the fastener to thereby drive the fastener through the workpiece towards the fastener support. In some instances the fastener support may exert a reaction force on the fastener as a result of a force applied to the fastener by the fastener insertion device. The forces acting on the fastener may cause the fastener to deform and thereby secure the two or more portions of the workpiece together.

Examples of such fasteners include rivets, mechanical studs and other types of fastening devices. A particular type of known rivet is the self-piercing rivet. The use of such rivets in conjunction with suitable adhesives or otherwise has become widespread and desirable in industries in which welding is not practical. Such industries include industries which utilise aluminium components. One example of such an industry is the automotive industry in which stacks of metal sheets, including at least one aluminium sheet, may need to be fastened together.

As discussed above, known fastening apparatus includes a fastener support, and a fastener insertion device. The fastener insertion device may include a nose assembly into which a rivet is passed from a rivet storage location, and from which the rivet is inserted into the workpiece by a punch. The fastener support includes an upsetting die which is located beneath the workpiece and which is configured to upset the rivet when the rivet is inserted into the workpiece. The volume and shape of the upsetting die is chosen to provide a desired degree of upsetting such that the rivet adopts a desired shape when it is inserted into the workpiece by the punch.

Feeding apparatus that enables different types of rivet (i.e. rivets having different shapes, dimensions and/or material etc.) to be fed to the nose assembly is already known. When it is desired to fasten different workpieces or different locations on a workpiece which have different fastening requirements (for example, where there is a different number of sheets forming the workpiece/workpiece portion, a different combination of material types and/or different thicknesses of the sheets of the workpiece/workpiece portion, and/or there is a need to use a different type of rivet (as discussed above)), it is frequently necessary to remove the upsetting die and replace it with a different upsetting die which has a different volume and/or shape that is more suited to the different rivet and/or characteristics of the workpiece/workpiece portion concerned.

Die changers for removing and replacing dies of a fastening apparatus are already known. Such die changers can be relatively inefficient to use. Anything that can be done to improve the efficiency of the die changers, and thereby reduce maintenance downtime and/or latent periods during the operation of the fastening apparatus will be advantageous.

It is desirable to provide an apparatus and method which mitigates at least one of the problems associated with known die changers, whether discussed herein or not.

According to the first aspect of the invention there is provided a fastening apparatus die cartridge, the cartridge comprising a main body defining a cavity configured to receive a plurality of dies; and an opening through which dies received by the cavity can be removed from the cavity; and an engagement portion configured to engage with a complementary engagement portion of a die changer of a fastening apparatus.

The cartridge provides an efficient way of supplying a plurality of dies to the fastening apparatus.

Where it is said that the cartridge includes an opening through which dies received by the cavity can be removed from the cavity, it should be clear that all that is required is that dies located within the cavity are removed via the opening. In order to insert the dies into the cavity, prior to their removal, the dies may be inserted via the opening or may be inserted via another route (for example, via a removable base of the cartridge).

The cartridge may comprise a biasing member configured to bias any dies received by the cavity towards the opening. This facilitates removal of dies contained within the cavity from the cartridge.

The cartridge may comprise a platform, the platform being located, at least in part, within the cavity. The biasing member may contact the platform and wherein the platform may be configured to contact a die received by the cavity, such that the biasing member is configured to bias, via the platform, any dies received by the cavity towards the opening. The platform provides a way of applying the force exerted by the biasing member in a more uniform manner.

The cavity may be configured to receive a plurality of dies of identical type.

The cartridge may be formed from first and second separate portions, the first portion including the main body, and the second portion including the engagement portion. The second portion may be fixed to a portion of a fastening apparatus such that when the cartridge is replenished the second portion remains fixed to the fastening apparatus and only the first portion is replaced (with a first portion that has a cavity which is full of dies).

The first portion may include a first interlock portion, and the second portion may include a second interlock portion, the first and second interlock portions co-operating to secure the first and second portions together, wherein the first interlock portion may have a configuration selected from a plurality of different configurations, each different configuration corresponding to a particular type of die, and wherein the configuration selected from said plurality of different configurations corresponds to the particular type of die received by the cavity of the first portion.

Likewise, the second interlock portion may have a configuration selected from a plurality of different configurations, each different configuration corresponding to a particular type of die, and wherein the configuration selected from said plurality of different configurations corresponds to the particular type of die received by the cavity of a first portion to which it is desired for the second portion to secure. Put another way, it may be desirable for dies of a particular type to form part of a particular cartridge. In this situation the second interlock portion will have a configuration which is complementary to that of the first interlock portion for dies of the desired particular type.

The cartridge may further comprise a clamp arrangement. The clamp arrangement may be located adjacent the opening. The clamp arrangement may be movable between a clamped configuration in which a clamp member engages a die located in the cavity adjacent the opening, such that said die and any other die within the cavity are substantially prevented from leaving the cavity via the opening; and an open configuration in which the clamp member does not engage said die, such that said die is permitted to leave the cavity via the opening.

The clamp arrangement may be configured to be engaged by a portion of the fastening apparatus. The portion of fastening apparatus may move the clamp arrangement between the clamped configuration and the open configuration.

The cartridge may comprise a guide member which is movable between a retracted position and a deployed position in which it is located outside of the cavity, adjacent the opening. The guide member may be configured to guide a die which exits the cavity via the opening.

The cartridge may further comprise a guide biasing member, the guide biasing member contacting the guide member in order to bias it out of the retracted position and into the deployed position.

The cartridge may further comprise a retaining portion. The retaining portion may be configured to move between a retaining configuration and a released configuration. In the retaining configuration the retaining portion may be mechanically linked between a portion of the main body and the biasing member so as to hold the biasing member in an energised state and substantially prevent the biasing member from exerting a force on any die located in the cavity. In the released configuration the retaining portion may not mechanically link said portion of the main body and the biasing member, such that the retaining portion does not hold the biasing member in an energised state, such that the biasing member may exert a force on a die located in the cavity.

The cartridge may further comprise a ratchet feature which is configured to permit movement of a die within the cavity towards the opening, and to substantially prevent movement of said die away from the opening.

The ratchet feature nay comprise a platform member, the platform member being located, at least in part, within the cavity, wherein the platform member is configured to contact a die received by the cavity. The platform member may include a first ratchet portion and the main body of the cartridge may comprise a corresponding second ratchet portion, and wherein if the platform member moves in a first direction to urge a die located in the cavity towards the opening, the first and second ratchet portions pass one another to enable the platform member to move relative to the main body, and if the platform member moves in a direction opposite to the first direction, the first and second ratchet portions engage one another to limit movement of the platform member relative to the main body.

The platform and platform member may be one and the same.

A frangible section of the cartridge may be provided which joins the engagement portion to the main body.

According to a second aspect of the invention there is provided a method of fastening at least two sheets of material together comprising: a fastening apparatus obtaining a die from a die cartridge according to the first aspect of the invention; inserting a fastener through said at least two sheets of material; and the die applying a force to the fastener in order to deform the fastener and thereby fasten said at least two sheets of material together.

According to a third aspect of the invention there is provided a method of producing an article, the method comprising fastening at least two sheets of material together in accordance with the second aspect of the invention.

It will be appreciated that, where appropriate, any of the optional features discussed above in relation to one of the aspects of the invention, may equally be applied to any of the other aspects of the invention.

BRIEF DESCRIPTION OF THE DRAWINGS

Specific embodiments of the present invention will now be described, by way of example only, with reference to the accompanying drawings in which.

DETAILED DESCRIPTION

It will be appreciated that, although, for the sake of simplicity, the present invention is described in relation to a cartridge or cartridge arrangement for dies of a self-piercing rivet setter, the invention is equally applicable to any fastening apparatus in which the fastener support includes a portion which must be regularly changed. A plurality of said regularly changed portions may be held by a cartridge or cartridge arrangement according to the present invention.

Figure 1:
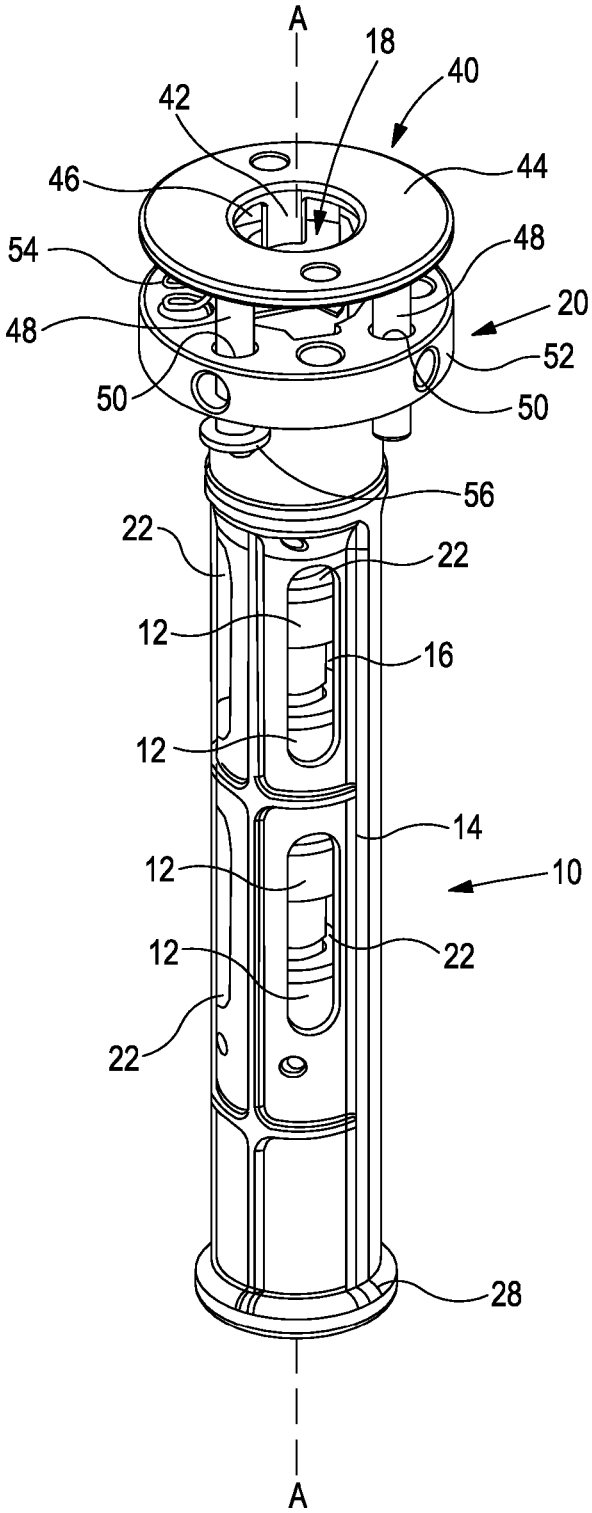
FIG. 1 shows a perspective view of a cartridge assembly according to an embodiment of the present invention.

FIG. 1 shows a perspective view of a cartridge assembly (or cartridge) 10 according to an embodiment of the present invention. The cartridge 10 may form part of a fastening apparatus as discussed in more detail later within this document. The cartridge 10 is shown within FIG. 1 in a full configuration in which it contains a plurality of dies 12.

The cartridge 10 comprises a main body 14 formed from a generally cylindrical wall which extends along a central longitudinal axis A and is closed at one end by a base 28. The main body 14 defines a generally cylindrical cavity 16 configured to receive a plurality of dies 12. The cartridge 10 also includes an opening 18 through which dies 12 located in the cavity 16 can be removed from the cavity 16 and hence from the cartridge 10. The cartridge 10 further includes an engagement portion 20 configured to engage with a complimentary engagement portion of a die changer of a fastening apparatus. One such example is that the engagement portion 20 may engage with a first die support 62 of a die changer so as to secure the cartridge to the first die support 62. Such an arrangement is discussed in the co-filed UK patent application relating to a die changer, filed by the present applicant having the same filing date as the present application. In those jurisdictions where it is possible, the contents of the co-filed UK patent application relating to the die changer and attached cartridges is hereby incorporated by reference.

The present embodiment includes a number of windows 22 in the main body 14 of the cartridge 10. The windows 22 provide a line of sight into the cavity (other than via the opening 18) which enables a user to readily determine the presence or otherwise of dies 12 within the cavity 16 (or, indeed, the number of dies present). This enables a user to readily determine whether the cartridge is full or empty and/or what number of dies are present within the cavity. It will be appreciated that although a plurality of windows 22 are shown in the present embodiment, in other embodiments of the invention there may be any appropriate number (e.g. one or more) windows provided. These windows may have any appropriate shape or location on the main body of the cartridge. In the situation where there are a plurality of windows, the windows may all have the same shape and (angular or axial) location or the shape and/or location of each window may be different.

In one embodiment, a window may be provided at a location on the main body which enables a line of sight through the wall of the main body 14 to the position within the cavity 16 a die occupies just before it exits the cavity via the opening 18. In this way, when no die 12 is visible through any of the one or more windows 22, this shows that the cartridge 10 (and in particular the cavity 16) is empty of dies. Alternatively, or in addition, the cartridge may be provided with one or more windows located so as to provide a line of sight to the position a die furthest from the opening 18 occupies when the cartridge (and in particular the cavity) is completely full of dies (i.e. when no dies have been removed from the cartridge). In this way, it will be possible for a user to determine whether the cartridge is completely full of dies or not.

Figure 2:
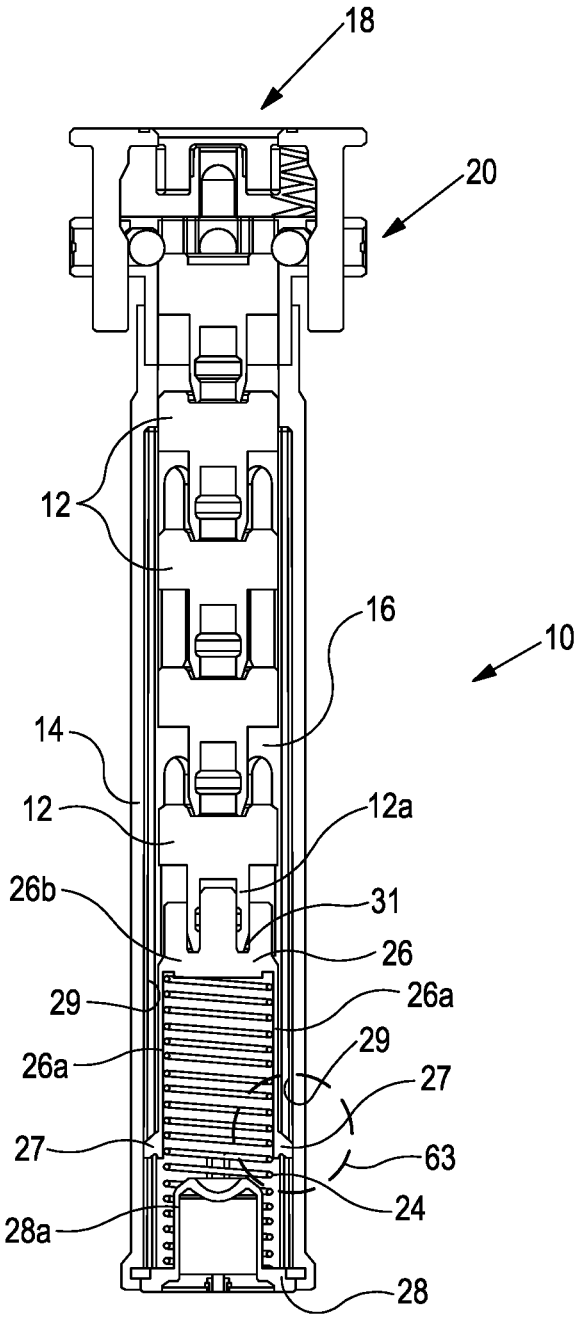
FIG. 2 shows a cross-sectional view of the cartridge assembly shown in FIG. 1.

Referring now to FIG. 2, which shows a cross sectional view of the cartridge shown in FIG. 1, it can be seen that the cartridge 10 comprises a platform 26 which has a generally circular cross section perpendicular to axis A and is sized so as to be a complementary fit within the generally cylindrical cavity 16. The platform 26 is mounted within the cavity 16 such that it is axially movable within the cavity 26. The platform 26 may be mounted for axial movement within the cavity in any appropriate manner. For example, in one embodiment, the platform may include one or more radially projecting tabs 27 which are each received by a corresponding axially extending channel 29 on the radially innermost side of the cylindrical wall of the main body 14. In the shown embodiment the tabs 27 are provided on a pair of axially extending legs 26*a* which depend from a main body 26*b* of the platform 26. A biasing member 24 (for example, a compression spring) is configured to bias any dies 12 located in the cavity 16 towards the opening 18. In order to do this the biasing member is located between the platform 26 and base 28 of the main body 14. The base 28 of the main body includes a boss 28*a* which helps to centralise the biasing member on the axis A. The biasing member 24 biases the platform 26 (and hence the dies 12 supported by the platform 26) towards the opening 18. In the present embodiment, the biasing member biases the dies 12 (via the platform 26) in an axial direction towards the opening 18.

As previously discussed, the platform 26 is located within the cavity 16 and the biasing member 24 contacts the platform 26. The platform 26 is configured to contact a die 12 received by the cavity 16, such that the biasing member 24 is configured to urge, via the platform 26, any dies located in the cavity 16 towards the opening 18. In the present embodiment an upper face of the main body 26*b* of the platform 26 includes an annular groove 31. The annular groove is sized and shaped to receive the stem 12*a* of a die received by the cavity 16, said die being the closest die to the platform. This helps the dies received by the cavity to be centralised on the platform and therefore helps to ensure that the force exerted by the spring 24 on the dies is relatively uniform, thereby reducing the likelihood of dies becoming jammed within the cavity. It can also be seen that the underside of the main body 26*b* of the platform 26, in combination with the two legs, helps to contain the spring 24 to ensure that it is centralised and is not able to move around on the underside of the main body. Again, this helps to ensure that the force exerted by the spring 24 on the dies is relatively uniform; thereby reducing the likelihood of dies becoming jammed within the cavity. In other embodiments, any appropriate configuration of platform may be used.

In the present embodiment, the dies 12 received by the cavity 18 are all of identical type. In this way the cartridge 10 is a cartridge which contains a single particular type of die. In other embodiments this need not be the case.

Figure 3:
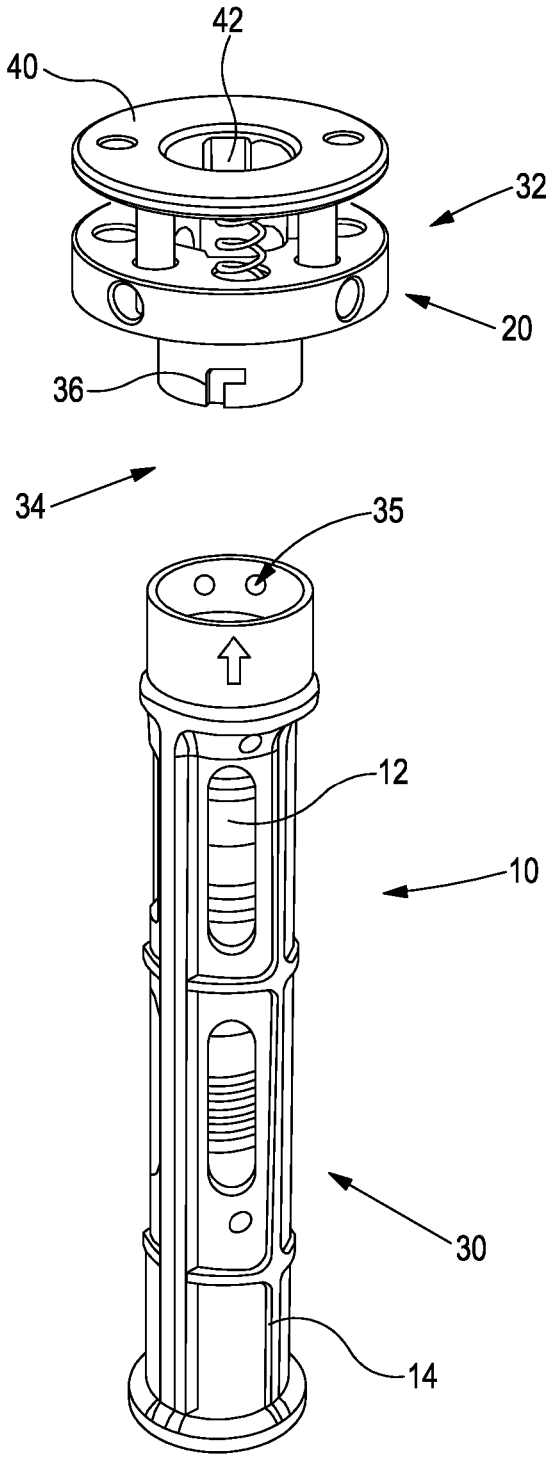
FIG. 3 shows a further perspective view of the cartridge assembly as shown in FIG. 1 in which first and second portions of the cartridge assembly are separate.

FIG. 3 shows a schematic perspective exploded view of the cartridge 10 shown in the previous figures. The cartridge is formed from a first portion 30 a separate second portion 32. The first portion 30 includes the main body 14 and the second portion 32 includes the engagement portion 20. The first and second portions 30, 32 are held together by an interlock 34. The interlock 34 comprises a first interlock portion 35 which forms part of the first portion 30 and a second interlock portion 36 which forms part of the second portion 32. In particular, in the present embodiment, the first interlock portion 35 comprises bayonet lugs and the second interlock portion 36 comprises corresponding bayonet openings 36 which co-operate in the known manner of bayonet fixings to secure the first and second portions 30, 32 together.

Figure 3A:
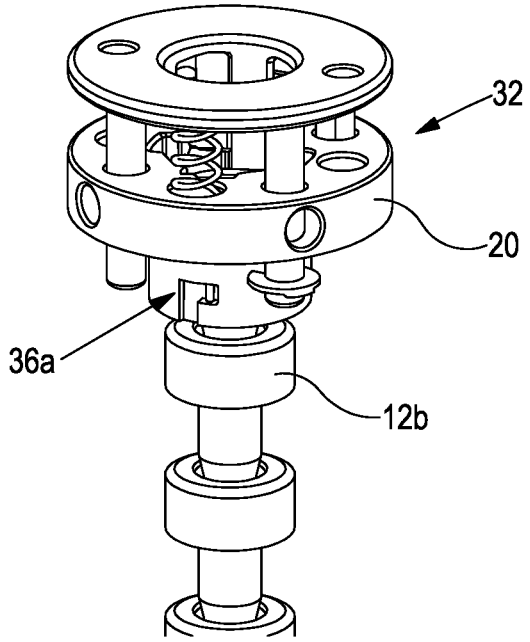
FIGS. 3A and 3B show perspective views of two different types of the second cartridge portion which may form part of the cartridge of FIG. 1.
Figure 3B:
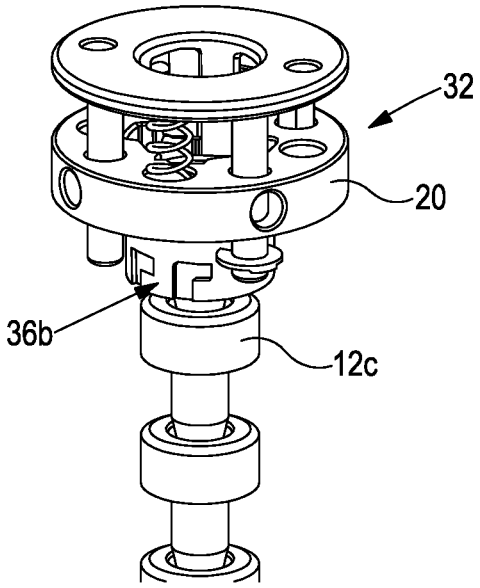

In the present embodiment, the first interlock portion 35 has a particular configuration selected from a set of different configurations, each different configuration within the set corresponding to a particular type of die. The configuration selected for the first interlock portion 35 in the present case corresponds to the particular type of die 12 received by the cavity 16. That is to say, in another embodiment, where the type of die received by the cavity is different to the type of die 12 received in the present case, the configuration of the first interlock portion 35 would be a different configuration from the set to that in the present case. FIGS. 3*a* and 3*b* show two particular different configurations of the second interlock portion 36 which corresponds to different types of die.

In more detail, FIGS. 3*a* and 3*b* show two different versions of second interlock portion. In particular, FIG. 3*a* shows a second portion 32 of a cartridge which comprises a first type of second interlock portion 36*a;* whereas FIG. 3*b* shows a second portion 32 of a cartridge which comprises a second type of second interlock portion 36*b*. The first type of second interlock portion 36*a* corresponds to a first type of die 12*b* and comprises a single bayonet opening per side of the second cartridge portion 32; whereas a second type of second interlock portion 36*b* corresponds to a second type of die 12*c* and comprises a two bayonet openings per side of the second cartridge portion 32. It will be appreciated that the cartridge main bodies which contain the relevant dies 12*b*, 12*c* have interlock portions which correspond to the relevant second interlock portions. In particular, the first interlock portion of the main body which contains dies of type 12*b* will include a single bayonet lug per side, whereas the first interlock portion of the main body which contains dies of type 12*c* will include two bayonet lugs per side.

In the manner discussed above, the second interlock portion 36 of the second portion 32 of the cartridge, which may be fixed to the die changer 62 of a fastening apparatus with which the cartridge is used, can have a configuration which is designed only to correctly engage with a first interlock portion 35 of a first portion 30 of a cartridge which includes a particular desired type of die. Put another way, a first portion 30 of a cartridge containing an undesirable type of die will have a first interlock portion 35 with a configuration which is not complimentary to the second interlock portion 36 of the second portion 32 of the cartridge, and, consequently, such cartridge first portions will not be able to be correctly engaged with the second portion 32 of the cartridge, thereby preventing an incorrect first portion 30 (and hence incorrect dies) from being mounted to the second portion 32, and hence the die changer to which the second portion 32 is mounted.

Although a set of two specific examples of interlock are described above, it will be appreciated that in other embodiments any appropriate specific configuration of interlock or interlock portions may be used to differentiate a first portion of cartridge containing one type of die from that of another. Furthermore, the set of configurations of the first and second interlock portions may have any appropriate number of members—a single member or a plurality of members.

Although in the present embodiment the first interlock portion of the first portion 30 comprises bayonet lugs and the second interlock portion of the second portion 32 comprises a bayonet opening 36, it will be appreciated that in other embodiments the location of the bayonet lugs and bayonet openings on the first and second portions may be exchanged/reversed. Alternatively, the first interlock portion and second interlock portion of the first and second portions respectively may include any appropriate structure which enables the first and second interlock portions (and hence the first and second portions 30, 32) to be secured/connected together, whether removably or otherwise.

It is also worth noting that although it has previously been discussed regarding the first interlock portion 35 of the first portion of the cartridge having a different configuration dependent upon the particular type of die contained within the cartridge, in other embodiments the interlock (and hence first and second portions of the interlock) may be substantially the same regardless of the type of die within the cartridge and, instead, the engagement portion 20 of the cartridge may have a different configuration depending on the type of die located in the cavity of the cartridge. In this way the engagement portion of the die changer of a fastening apparatus with which the cartridge is used may have a particular configuration which corresponds to that of a particular desired type of die, such that only a engagement portion 20 of a cartridge containing said desired type of die and having a configuration which corresponds to said desired type of die will be able to secure/connect to the engagement portion 20. In this way the configurations of the engagement portions of the cartridge and the die changer of the fastening apparatus can be such that they prevent a cartridge containing an undesirable type of die from being connected to die changer of the fastening apparatus.

Figure 5:
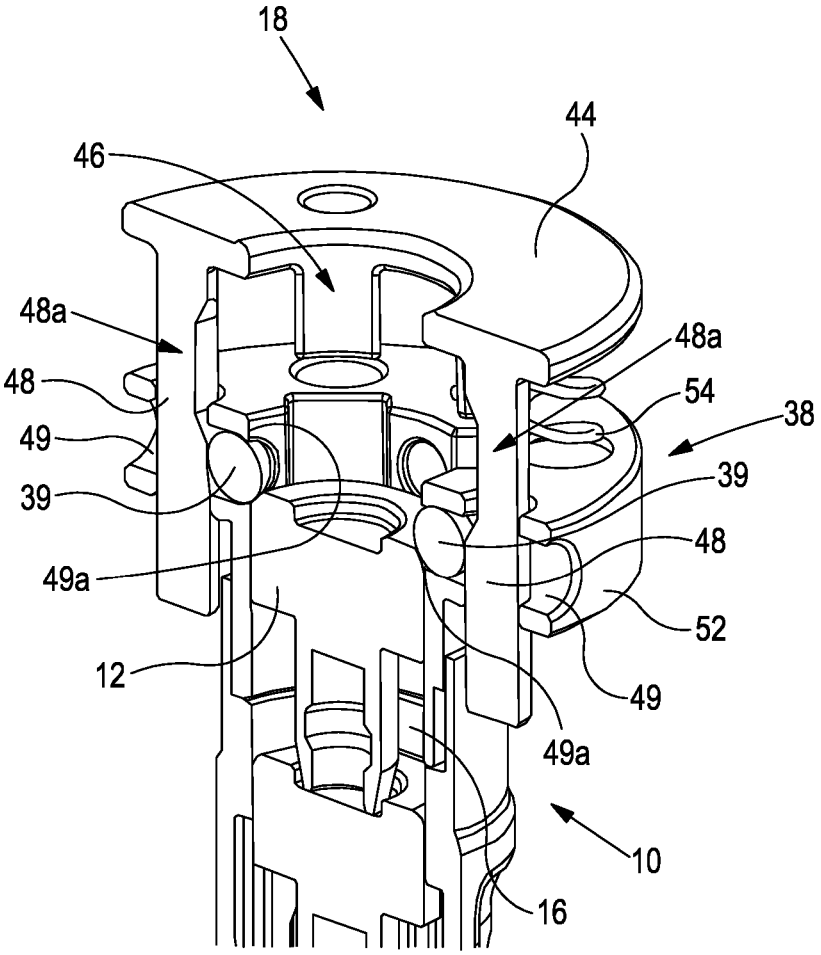
FIG. 5 shows a cross sectional view of a portion of the cartridge shown in FIG. 1, in which a clamp arrangement is prominent.

As best seen in FIG. 5, the cartridge 10 further comprises a clamp arrangement 38. The clamp arrangement 38 is located adjacent to the opening 18. In particular, the clamp arrangement forms part of the second portion 32 of the cartridge and comprises an actuation portion and a plurality of ball bearings 39.

The clamp arrangement is moveable between a clamped configuration and an open configuration. In the clamped configuration the clamp member engages a die 12 located in the cavity 16 adjacent the opening 18 such that said die and any other die within the cavity are substantially prevented from leaving the cavity via the opening 18. In particular, as previously discussed, the dies 12 are urged towards the opening 18 by the biasing member 24. Consequently, without the clamp member the dies would be urged by the biasing member so as to leave the cartridge 10. This is of course undesirable because each die should only be released from the cartridge when required.

The clamp arrangement also has an open configuration in which the clamp member does not engage said die. In this configuration said die is permitted to leave the cavity via the opening. Once the clamp arrangement is in the open configuration the biasing member 24 will urge the die out of the opening 18.

This feature may enable the die changer of a fastening apparatus with which the cartridge is utilised to selectively actuate and de-actuate the clamp arrangement so as to move the clamp arrangement between the clamped configuration, when the die(s) within the cartridge are to remain in situ, and the open configuration when the die changer wishes to remove a die from the cartridge. To this end, the clamp arrangement is configured to be engaged by a portion of the fastening apparatus such that the portion of the fastening apparatus moves the clamp arrangement between the clamped configuration and the open configuration. In particular, the clamp arrangement includes an actuation portion which is engaged by and actuated by said portion of the fastening apparatus. By moving the actuation portion between un-actuated and actuated positions the portion of the fastening apparatus moves the clamp arrangement between the clamped configuration and the open configuration.

Still referring to FIG. 5, in the present embodiment the actuation portion comprises a guide plate 44 from which several axially extending supports 48 depend. The supports 48 are received by corresponding, axially extending, angularly spaced bores 50 which are provided in a collar portion 52 of the engagement portion 20 of the cartridge. Each of the supports 48 has a tapered portion 48*a* of reduced diameter. Associated with each support 48 is a radial bore 49 which intersects the relevant axial bore 50. A ball bearing 39 is received within each radial bore 49 and is held captive between the relevant support 48 and a reduced diameter portion 49*a* of the radial bore 49 which is located adjacent the aperture 18. During operation, the clamp arrangement 38 is moveable between a clamped configuration and an open configuration. In the clamped configuration (as shown in FIG. 5) the clamp member engages a die 12 located in the cavity 16 adjacent the opening 18 such that said die and any other die within the cavity are substantially prevented from leaving the cavity via the opening 18. In the present embodiment the clamp member takes the form of each of the ball bearings 39. The actuation portion is urged into the clamped configuration by the resilient biasing member 54. In this position of the actuation portion a full diameter portion of each support 48 is located in each radial bore 49. This results in the ball bearings 39 being urged radially inwards along their respective bores 49 and the ball bearings 39 engaging the die 12.

In the present embodiment, in order to move the clamp arrangement 38 into the open configuration, the actuation portion is urged axially downwards (with respect to the orientation of the figures), against the action of the spring 54, until the guide plate 44 contacts the collar 52. In this position, although not shown in the Figures, the tapered portion 48*a* of each support 48 is received within the radial bore 49 and hence each ball bearing is free to move radially outwards into the additional space created in each bore 49 by the tapered portion 48*a*. The ability of the ball bearings 39 to move radially outwards means that the ball bearings 39 do not engage the die 12. In this context, lack of engagement may include a scenario in which the ball bearings contact the die, but do not exert enough force on the die to prevent it from moving axially towards the opening under the action of the biasing member 24.

The cartridge 10 further comprises a guide member 40. The guide member 40 is movable between a retracted position and a deployed position in which it is located outside of the cavity 16 adjacent the opening 18. The guide member 40 is configured to guide a die 12 which exits the cavity 16 via the opining 18. In particular, in the deployed position, a guide portion of the guide member is located such that as a die exits the cavity via the opening, the die can contact the guide portion in order to ensure that the die moves in the correct direction when exiting the cavity, thereby preventing dies which exit the cavity via the opening from exiting in the wrong direction or with the wrong orientation. This may be of particular importance when the die leaving the cavity of the cartridge must be received in a correct orientation and at a correct position relative to a portion of a fastening apparatus, for example a die changer.

In the present embodiment, the guide portion of the guide member 40 is the wall of aperture 46 in the guide plate 44 and/or a pair of generally axially extending legs 42. The legs 42 are diametrically spaced relative to the axis A. Only one of the legs 42 is visible within the figures. In other embodiments, any appropriate configuration of guide portion may be used provided it is capable of exerting a force (e.g. by contact) on a die exiting the cavity via the opening so as to ensure that the die is moving in the correct direction/orientation.

In the embodiment shown, the guide member 40 includes a generally annular guide plate 44 which lies in a plane generally perpendicular to the axis A. The guide plate 44 comprises an aperture 46 through which a die 12 can pass once it has exited the cavity. The guide member 40 also includes a pair of guide legs 42 (already discussed) which depend from the guide plate 44 in a generally axial direction such that they are adjacent the aperture 46 and thereby define at least a portion of a circumferential surface which defines said aperture 46. In addition, the guide member also includes three generally axially extending supports 48. The axially extending supports 48 depend from the guide plate 44 at locations which are equi-angularly spaced about the axis A. The supports 48 are received by corresponding, axially extending, angularly spaced bores 50 which are provided in a collar portion 52 of the engagement portion 20 of the cartridge.

In the present embodiment, a resilient biasing member 54 in the form of a spring is received between the collar 52 and guide plate 44 of the guide member 40. The supports 48 extend all the way through the bores 50 of the collar 52 such that they protrude from the opposite side of the collar to that on which the guide plate is located. Cooperation of the support 48 and bores 50 enables the guide member 40 to move axially relative to the collar 50 and hence the engagement portion/main body of the cartridge. A stop 56 is located at a distal (or free) end of one of the supports 48. The stop 56 is larger than the size of the bore 50 through which the relevant support passes. Consequently, the stop 56 limits the movement of the guide member 44 away from the collar 52 in order to prevent the guide member 40 and remaining portion of the cartridge from being separated.

In the present embodiment the guide member 40 is movable generally axially from a retracted position in which the guide plate 44 is located generally adjacent the collar 52, and a deployed position (as shown in the figures) in which the guide plate is spaced from the collar by a predetermined distance. In addition, in the present embodiment, the spring 54 biases the guide member 40 out of the retracted position and into the deployed position.

In the present embodiment the guide plate 44 of the guide member is part of the actuation portion of the clamp arrangement which moves the clamp arrangement between clamped and open configurations. In other embodiments the guide member and the actuation portion may be separate entities. A benefit of the guide member and clamp arrangement being integrated is that they can co-operate to more effectively control the movement of dies as they exit the cavity and hence the cartridge.

In more detail, as previously discussed, in an undisturbed state the cartridge is such that the biasing member is urging the dies towards the opening of the cavity, however, because the clamping arrangement is biased into the clamped configuration, the dies are clamped in position so that they cannot exit the cavity. When it is desired to remove a die from the cartridge, a portion of a fastening apparatus is moved into contact with the guide plate of the guide member. The portion of the fastening apparatus moves the guide member from the deployed position to the retracted position. In this context the deployed position of the guide member corresponds to the clamped configuration of the clamp arrangement and the retracted position of the guide member corresponds to the open configuration of the clamp arrangement. As such, movement of the guide member from the deployed position to the retracted position results in the clamping arrangement moving from the clamped configuration to the open configuration. Once in the open configuration the die(s) within the cavity are free to move towards the opening under the action of the biasing member. The portion of the fastening apparatus which is moved into contact with the guide member may include a die removal portion for removing a die from the cartridge. The die closest the opening can then be removed from the cartridge by the die removal portion. As the die is removed from the cartridge the portion of the fastening apparatus is moved away from the cartridge. As this happens the guide member follows the portion of the fastening apparatus under the action of the spring 54 and moves axially away from the opening. In this way, as the die is removed from the cartridge by the portion of the fastening apparatus and moves away from the opening, the guide member also moves away from the opening. It follows that the guide member can maintain the correct orientation and position of the die as it is removed from the cartridge by the portion of the fastening apparatus. Once the portion of the fastening apparatus moves sufficiently away from the cartridge, the portion of the fastening apparatus no longer contacts the guide plate of the guide member and hence the guide member is in the deployed position. As discussed above, this means that the clamping arrangement is in the clamped configuration, thus clamping any die(s) remaining in the cartridge within the cavity. When it is desired to remove a further die from the cartridge the above process is repeated. Once all of the dies have been removed from the cartridge, the cartridge is empty. The cartridge can then be replaced, if desired, with a similar cartridge.

A cartridge according to the present invention may further comprise a retaining portion. The retaining portion is used to prevent the biasing member from exerting a force on any die located in the cavity, thus preventing the biasing member from urging a die located in the cavity out of the cartridge. This may be particularly beneficial when dies are being loaded into the cavity of the cartridge. If such a retaining portion did not exist then it is possible that, should sufficient grip on the inserted dies not be maintained, the dies could be ejected from the cavity under the action of the biasing member with sufficient force to cause injury to the person loading the cartridge or anyone else located nearby.

The retaining portion is configured to move between a retaining configuration and a released configuration. In the retaining configuration the retaining portion is mechanically linked between a portion of the main body and the biasing member so as to hold the biasing member in an energized state and substantially prevent the biasing member from exerting a force on any die located in the cavity. By energized state, what is meant is that the biasing member is held in the configuration in which, without the presence of the retaining portion, the biasing member would seek to alter its shape so as to attempt to return to a relaxed state, said altering in shape of the biasing member giving rise to the potential for a biasing member exerting a force on the dies located in the cavity. Furthermore, where it is said that the retaining portion is mechanically linked between a portion of the main body and the biasing member, such a mechanical link may be direct or indirect. In the case where the mechanical link is direct, the retaining portion will contact said portion of the main body and the biasing member. In the situation where the mechanical link is indirect, the portion of the main body and the biasing member will be linked via the retaining portion and one or more additional portions of the cartridge. An example of such an indirect mechanical link is where the retaining portion extends between said portion of the main body and the platform member of the cartridge. In this situation the retaining portion is mechanically linked between a portion of the main body and the biasing member via the platform member.

In the released configuration the retaining portion does not mechanically link said portion of the main body and the biasing member such that the retaining portion does not hold the biasing member in an energized state. In this way the biasing member may exert a force on a die located in the cavity (i.e. a force to urge the die towards the opening in the cartridge and hence to exit the cartridge, as discussed above).

Figure 4:
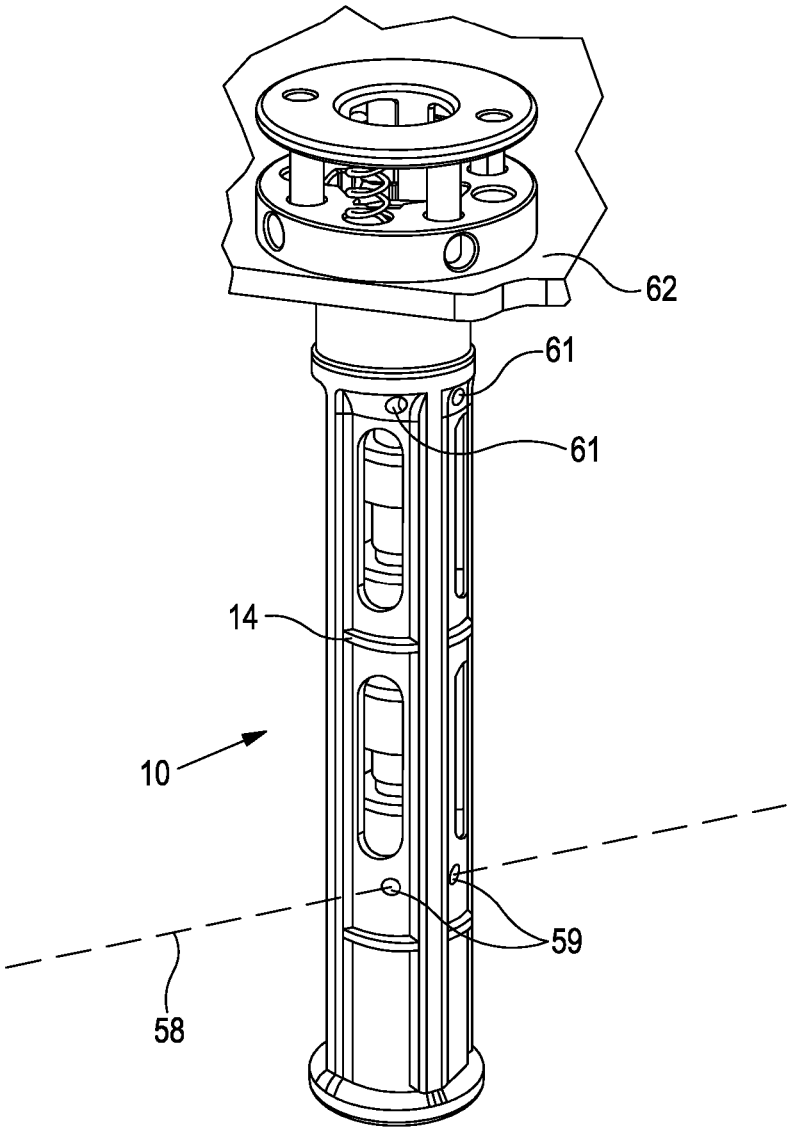
FIG. 4 shows a perspective view of the cartridge assembly of FIG. 1 in which the cartridge assembly forms part of a fastening apparatus.

In the present embodiment the retaining portion may take the form of a pin 58 (shown in dashed lines in FIG. 4) which passes through retaining apertures 59 in the main body 14 of the cartridge. In more detail, in the retaining configuration, when it is desired to retain the biasing member, the platform 26 is located at the base of the cavity 16 and the pin 58 is inserted through the retaining apertures 59. Under the action of the biasing member the platform 26 is urged into contact with the pin 58. As such the retaining portion in the form of the pin 58 is mechanically linked between a portion of the main body (the retaining apertures 59) and the biasing member so as to hold the biasing member in an energized state and substantially prevent the biasing member from exerting a force on any die located in the cavity. In the present case the mechanical link is indirect: the portion of the main body (retaining apertures 58) and the biasing member are linked via the retaining portion 58 and an additional portion of the cartridge in the form of the platform member 26.

In order to place the retaining portion in the released configuration the pin 58 is removed from the retaining apertures 59 such that it no longer mechanically links the retaining apertures of the main body and the biasing member, and hence the retaining portion no longer holds the biasing member in an energized state.

In the present embodiment the cartridge comprises a further retaining portion. The further retaining portion includes further retaining apertures 59. In use, as part of the further retaining portion, a tie (not shown) can be inserted through the further retaining apertures 59. In this position the tie abuts the uppermost die and prevents the dies from passing out of the main body of the first portion of the cartridge under the action of the biasing member 24. As such, in this configuration the first portion of the cartridge can be handled separately to the second portion of the cartridge without the risk of the dies being ejected. Once the first portion of the cartridge has been secured to the second portion of the cartridge, in the manner discussed above, the tie can be removed from the further retaining apertures and the dies are retained within the cartridge by the clamp arrangement. It will be appreciated that in other embodiments the further retaining portion may take any appropriate form provided it is capable of selectively retaining the dies within the first portion of the cartridge against the action of the biasing member 24.

Figure 6:
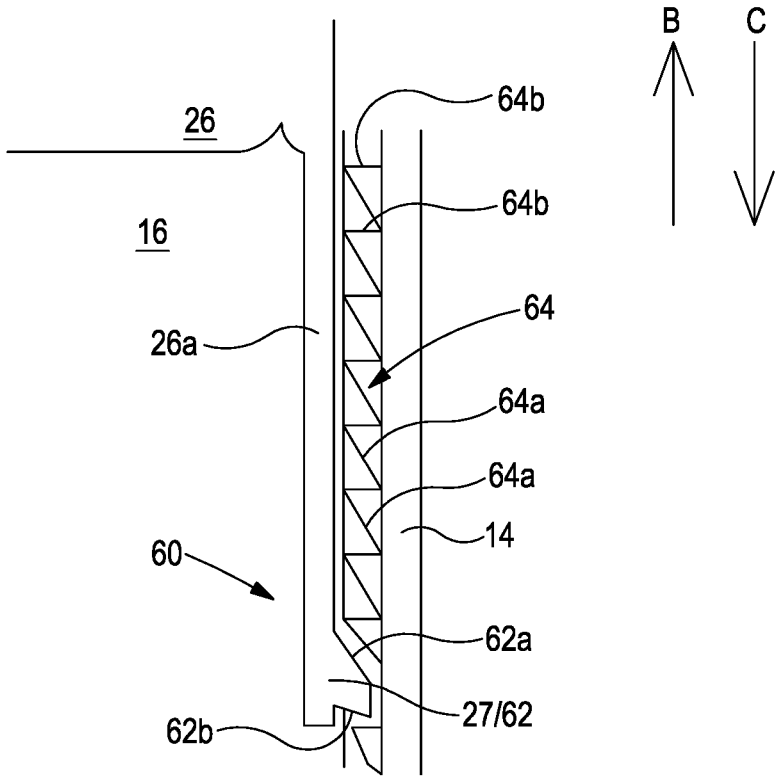
FIG. 6 shows a cross sectional view of a portion of the cartridge shown in FIG. 1, in which a ratchet feature is prominent.

The cartridge 10 further comprises a ratchet feature 60. The ratchet feature 60 is configured to permit movement of a die within the cavity 16 towards the opening 18, and to substantially prevent movement of said die away from the opening 18. The ratchet feature is best seen in FIG. 6 which shows a schematic view of the portion of FIG. 2 indicated by 63. One benefit of a cartridge including a ratchet feature is that the ratchet feature enables dies to be ejected from the cavity of the cartridge, but does not allow dies to be inserted into the cavity of the cartridge after the cartridge is initially assembled. An advantage of this is that if the cartridge is manufactured and then filled with a particular type of die, then once one or more of the relevant dies have been removed from the cartridge, it will not be possible to insert another die, which may potentially be a die which is of a different type to that originally loaded into the cartridge. This prevents potential contamination of the type of die within the cartridge which may be beneficial in situations where it is important that the cartridge only contains a particular desired type of die so that said desired type of die is the only type of die which is supplied to a fastening apparatus.

In the case of the present embodiment, the ratchet feature 60 comprises the platform 26 which, as previously discussed, is located, at least in part, within the cavity 16. Again, as previously discussed, the platform 26 is configured to contact a die received by the cavity. The platform 26 includes a first ratchet portion 62 and the main body 14 of the cartridge 10 comprises a corresponding second ratchet portion 64. In the present case the first ratchet portion 62 takes the form of a pawl located at a radially outer surface of the platform. In particular the pawl is formed by the tab 27 which protrudes from a leg 26*a* of the platform 26. The pawl has a generally saw tooth shaped feature. The second ratchet portion 64 is located on a radially inner surface of the generally cylindrical main body 14 of the cartridge 10. The second ratchet portion 64 takes the form of an arrangement having a generally saw tooth wave cross-section. The saw tooth wave cross section of the second ratchet portion 64 and the saw tooth of the first ratchet feature 62 are orientated relative to one another and the cartridge such that when the platform 26 moves in the direction B towards the opening of the cavity the angled surface 62*a* of the saw tooth of the first ratchet portion rides over the angled surfaces 64*a* of the saw tooth wave of the second ratchet portion. Conversely, once it is attempted to move the platform away from the opening of the cavity in the direction C, a generally radially extending portion 62*b* of the saw tooth of the first ratchet portion abuts with a generally radial surface 64*b* of one of the teeth of the saw tooth wave of the second ratchet portion, thereby preventing movement of the platform relative to the main body of the cartridge in a direction C away from the opening of the cavity.

In this way, if the platform member moves in the direction C opposite to the first direction (e.g. an axial direction away from the opening of the cavity), the first and second ratchet portions 62, 64 engage one another to limit the movement of the platform relative to the main body (and in particular limit movement of the platform member relative to the main body in the axial direction C away from the opening of the main body of the cartridge).

In the presently described embodiment the platform 26 which is acted upon by the biasing member 24 so as to urge the dies within the cavity out of the cavity is the same as the platform which includes the first ratchet portion of the ratchet feature 62. However, it will be appreciated that in other embodiments the platform including the first ratchet portion and the platform biased by the biasing member may be separate entities. Furthermore, in some embodiments, the ratchet feature may not require a platform- all that is required by the ratchet feature is that it can permit movement of a die within the cavity towards the opening, and substantially prevent movement of said die away from the opening. For example, the ratchet feature may comprise a hinged member which forms part of the main body. When a die moves next to the hinged member in a direction towards the opening, the hinged member moves out of the way of the die, allowing the die to pass. Conversely, when a die moves next to the hinged member in a direction away from the opening the hinged member abuts the die, preventing the die from passing.

Finally, the cartridge according to the present invention may include a frangible portion which preferentially separates when a user applies a force to the cartridge in order to separate the first cartridge portion 30 from the second cartridge portion 32. Once this has happened it is not possible to re-join the main body and the engagement portion (first portion 30 and second portion 32). This provides another security feature which ensures that it is not possible to break open the cartridge in order to replace the dies originally loaded into the cavity of the cartridge with other types of die. As previously discussed, this may be important in applications of the cartridge where it is essential that only the desired type of die is supplied to a fastening machine.

It will be appreciated that there are many modifications to the cartridge which are possible whilst still remaining a cartridge according to the present invention as claimed in the claims.

In one example, whilst the dies contained within the cartridge have a circular cross-section such that the inner surface of the wall of the main body (and cavity) also has a corresponding circular cross-section, in other embodiments the cross-section of the die and hence the cross-section of the wall of the main body (and hence cavity) may have any appropriate shape.

Furthermore, it is envisaged that the cartridge may include an identification portion. The identification portion may contain any appropriate information, for example an identifier for the cartridge, and/or information regarding the dies contained within the cartridge. The identification portion may contain visual information or machine readable information.

The invention claimed is:

1. A fastening apparatus die cartridge, the cartridge comprising:

a main body defining a cavity configured to simultaneously receive a plurality of dies; and an opening through which dies received by the cavity can be removed from the cavity; and an engagement portion configured to engage with a complementary engagement portion of a die changer of a fastening apparatus.

2. A cartridge according to claim 1, comprising a biasing member configured to bias any dies received by the cavity towards the opening.

3. A cartridge according to claim 2, comprising a platform, the platform being located, at least in part, within the cavity, wherein the biasing member contacts the platform and wherein the platform is configured to contact a die received by the cavity, such that the biasing member is configured to bias, via the platform, any dies received by the cavity towards the opening.

4. A cartridge according to claim 1 wherein the cavity is configured to receive a plurality of dies of identical type.

5. A cartridge according to claim 1, wherein the cartridge is formed from first and second separate portions, the first portion including the main body, and the second portion including the engagement portion.

6. A cartridge according to claim 5, wherein the first portion includes a first interlock portion, and the second portion includes a second interlock portion, the first and second interlock portions co-operating to secure the first and second portions together, wherein the first interlock portion has a configuration selected from a plurality of different configurations, each different configuration corresponding to a particular type of die, and wherein the configuration selected from said plurality of different configurations corresponds to the particular type of die received by the cavity.

7. A cartridge according to claim 1, wherein the cartridge further comprises a clamp arrangement, the clamp arrangement being located adjacent the opening, wherein the clamp arrangement is movable between a clamped configuration in which a clamp member engages a die located in the cavity adjacent the opening, such that said die and any other die within the cavity are substantially prevented from leaving the cavity via the opening; and an open configuration in which the clamp member does not engage said die, such that said die is permitted to leave the cavity via the opening.

8. A cartridge according to claim 7, wherein the clamp arrangement is configured to be engaged by a portion of the fastening apparatus, wherein the portion of fastening apparatus may move the clamp arrangement between the clamped configuration and the open configuration.

9. A cartridge according to claim 1, comprising a guide member which is movable between a retracted position and a deployed position in which it is located outside of the cavity, adjacent the opening, and configured to guide a die which exits the cavity via the opening.

10. A cartridge according to claim 9, further comprising a guide biasing member, the guide biasing member contacting the guide member in order to bias it out of the retracted position and into the deployed position.

11. A cartridge according to claim 2, further comprising a retaining portion, the retaining portion configured to move between a retaining configuration and a released configuration, wherein in the retaining configuration the retaining portion is mechanically linked between a portion of the main body and the biasing member so as to hold the biasing member in an energised state and substantially prevent the biasing member from exerting a force on any die located in the cavity, and wherein in the released configuration the retaining portion does not mechanically link said portion of the main body and the biasing member such that the retaining portion does not hold the biasing member in an energised state such that the biasing member may exert a force on a die located in the cavity.

12. A cartridge according to claim 1, further comprising a ratchet feature which is configured to permit movement of a die within the cavity towards the opening, and to substantially prevent movement of said die away from the opening.

13. A cartridge according to claim 12, wherein the ratchet feature comprises a platform member, the platform member being located, at least in part, within the cavity, wherein the platform member is configured to contact a die received by the cavity, wherein the platform member includes a first ratchet portion and the main body of the cartridge comprises a corresponding second ratchet portion, and wherein if the platform member moves in a first direction to urge a die located in the cavity towards the opening, the first and second ratchet portions pass one another to enable the platform member to move relative to the main body, and if the platform member moves in a direction opposite to the first direction, the first and second ratchet portions engage one another to limit movement of the platform member relative to the main body.

14. A cartridge according to claim 13, comprising a biasing member configured to bias any dies received by the cavity towards the opening; and a platform, the platform being located, at least in part, within the cavity, wherein the biasing member contacts the platform and wherein the platform is configured to contact a die received by the cavity, such that the biasing member is configured to bias, via the platform, any dies received by the cavity towards the opening, and wherein the platform and platform member are one and the same.

15. A method of fastening at least two sheets of material together comprising:

a fastening apparatus obtaining a die from a die cartridge having a main body defining a cavity configured to receive a plurality of dies; and an opening through which dies received by the cavity can be removed from the cavity;

and an engagement portion configured to engage with a complementary engagement portion of a die changer of a fastening apparatus;

inserting a fastener through said at least two sheets of material; and the die applying a force to the fastener in order to deform the fastener and thereby fasten said at least two sheets of material together.

16. A method of producing an article, the method comprising: fastening at least two sheets of material together with a fastening apparatus;

obtaining a die from a die cartridge having a main body defining a cavity configured to receive a plurality of dies; and an opening through which dies received by the cavity can be removed from the cavity;

and an engagement portion configured to engage with a complementary engagement portion of a die changer of a fastening apparatus;

inserting a fastener through said at least two sheets of material; and the die applying a force to the fastener in order to deform the fastener and thereby fasten said at least two sheets of material together.

* * * * *